US009271560B2

(12) United States Patent
Buffinton et al.

(10) Patent No.: US 9,271,560 B2
(45) Date of Patent: Mar. 1, 2016

(54) BACKPACK COMPRISING A FRAME STRUCTURE FOR STRETCHING A NETTING MEMBER CONCAVE ACROSS THE BACK WALL

(75) Inventors: Stephen Buffinton, Augsburg (DE); Thomas Hilger, Bobingen (DE); Miguel Tiblas, Augsburg (DE)

(73) Assignee: Deuter Sport GmbH & Co. KG, Gersthofen (DE)

( * ) Notice: Subject to any disclaimer, the term of this patent is extended or adjusted under 35 U.S.C. 154(b) by 690 days.

(21) Appl. No.: 12/803,453

(22) Filed: Jun. 28, 2010

(65) Prior Publication Data

US 2011/0011903 A1 Jan. 20, 2011

(30) Foreign Application Priority Data

Jul. 15, 2009 (DE) ..... 10 2009 033 518

(51) Int. Cl.

| | |
|---|---|
| ***A45F 3/10*** | (2006.01) |
| ***A45F 3/08*** | (2006.01) |
| *A45F 3/12* | (2006.01) |

(52) U.S. Cl.

CPC ..... *A45F 3/08* (2013.01); *A45F 2003/122* (2013.01); *A45F 2003/125* (2013.01)

(58) Field of Classification Search

CPC ..... A45F 3/08; A45F 3/10
USPC ..... 224/261, 263, 628, 633, 635
See application file for complete search history.

(56) References Cited

U.S. PATENT DOCUMENTS

| | | | | |
|---|---|---|---|---|
| 3,734,366 | A * | 5/1973 | Wood | 224/635 |
| 3,899,109 | A * | 8/1975 | Noice | 224/262 |
| 3,957,184 | A * | 5/1976 | Shurman | 224/630 |
| 4,074,839 | A * | 2/1978 | Wood et al. | 224/635 |
| 4,369,903 | A * | 1/1983 | Wilkes | 224/635 |
| 4,676,418 | A | 6/1987 | Lowe | |
| 5,292,043 | A * | 3/1994 | McHale | 224/634 |
| 5,704,530 | A * | 1/1998 | Scherer | 224/632 |
| 5,890,640 | A * | 4/1999 | Thompson | 224/630 |
| 6,325,262 | B1 * | 12/2001 | Thompson | 224/628 |
| 2006/0191969 | A1 * | 8/2006 | Goulding et al. | 224/635 |
| 2006/0208024 | A1 * | 9/2006 | Gleason, Jr. | 224/633 |
| 2010/0116861 | A1 * | 5/2010 | Burrowes | 224/633 |

FOREIGN PATENT DOCUMENTS

| | | |
|---|---|---|
| CH | 79582 A | 4/1919 |
| DE | 199 32 498 A1 | 2/2001 |

(Continued)

*Primary Examiner* — Brian D Nash

(74) *Attorney, Agent, or Firm* — Jura C. Zibas; Gregory N. Brescia; Wilson, Elser, Moskowitz, Edelman & Dicker, LLP.

(57) ABSTRACT

The invention relates to a backpack comprising a frame structure stretching the back wall (2) of backpack (1) to be concavely taut and holding a netting member (4) in front of the backpack back wall (2) in bowstring fashion. The frame structure comprises a resilient frame member (3) having a pair of frame portions (8, 9) intersecting in front of backpack back wall (2), a top frame portion (10) which extends in a transverse direction of backpack (1), interconnects the top ends of frame portions (8, 9) and is held against backpack back wall (2), and a frame portion (18) comprising two frame elements (19, 20) extending approximately in the longitudinal direction of backpack (1) and mutually spaced in a transverse direction thereof.

34 Claims, 3 Drawing Sheets

(56) References Cited

FOREIGN PATENT DOCUMENTS

Figure 1:
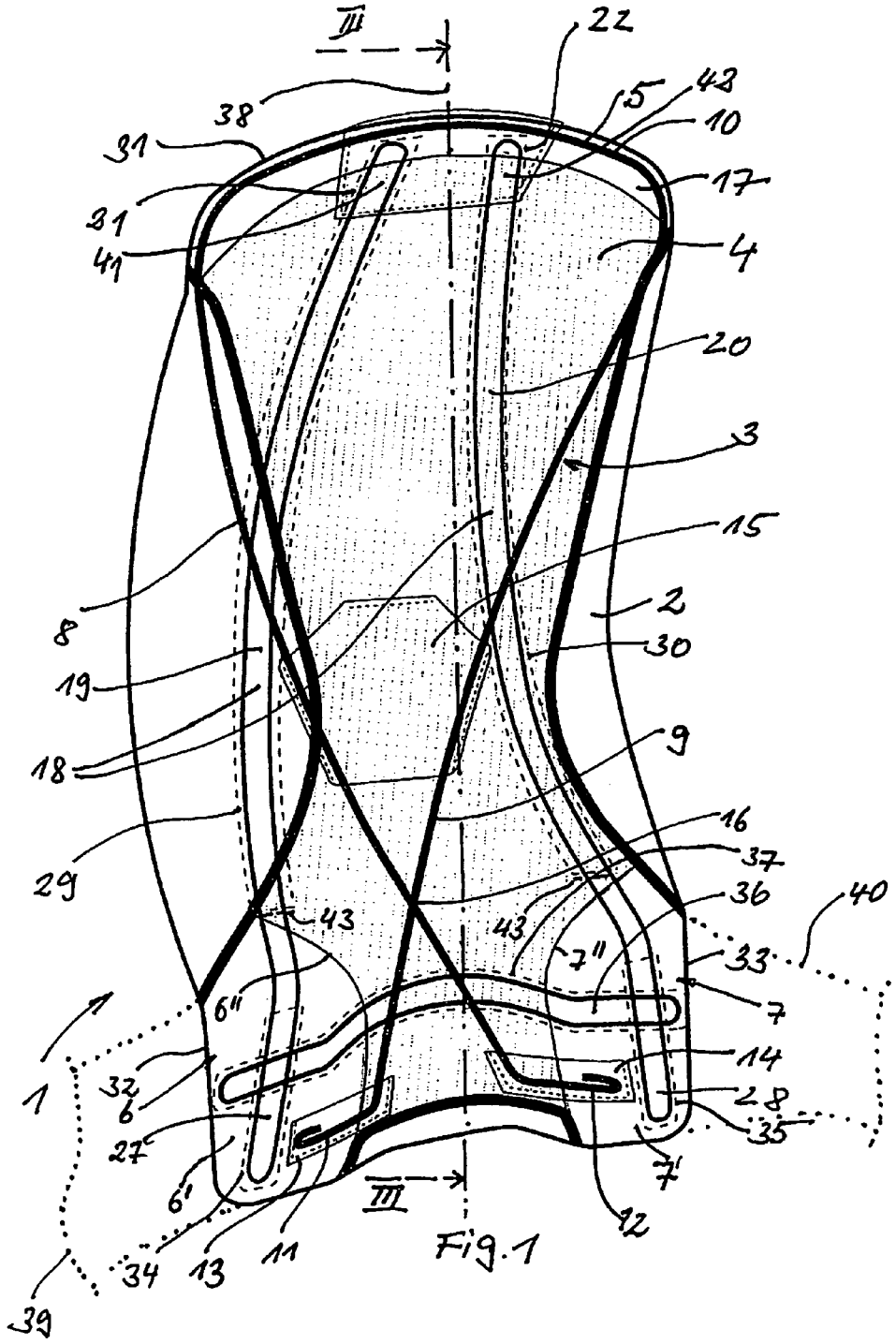

| | | | |
|---|---|---|---|
| EP | 0 158 154 | A2 | 10/1985 |
| EP | 1859703 | A1 | 11/2007 |
| FR | 821008 | A | 11/1937 |
| WO | WO 2008/066866 | A1 | 6/2008 |

* cited by examiner

BACKPACK COMPRISING A FRAME STRUCTURE FOR STRETCHING A NETTING MEMBER CONCAVE ACROSS THE BACK WALL

The present invention relates to a backpack comprising a frame structure for concavely stretching a netting member taut in front of the backpack's back wall.

Document EP 0 158 154 B1 discloses a backpack comprising a frame structure stretching a net member in front of the back wall of the backpack, with the frame structure comprising two frame members extending acutely in the longitudinal direction of the backpack, and top and bottom cross elements fixedly interconnecting the top and bottom ends, respectively, of the transversely spaced frame members. The bottom cross member is designed to acutely extend between the vertical frame members, with the end sections of said bottom cross member which extend beyond said vertical frame members inserted in pockets formed on the back wall of the backpack. The top cross member is inserted in a top pocket formed on the back wall of the backpack. A frame structure designed this way results in the netting being stretched concavely taut in front of the back wall of the backpack, thus ensuring a good ventilation between the back wall of the backpack and the portion of the netting which engages the back of the person carrying the backpack.

Document DE 199 32 498 A1 discloses another backpack frame structure which essentially comprises a rectangular flexible wire member having in the corner portions thereof supporting members inserted in pockets of a netting member stretched across the backpack's backwall so as to form a ventilation space between the netting and the back wall.

It is the object underlying the present invention to create a backpack comprising a frame structure stretching a netting member concavely taut in front of the backpack's back wall so as to ensure, when the backpack is being carried, a good ventilation of the space between the backpack's back wall and the netting, on the one hand, as well as, on the other hand, a free rotation of the backpack about its approximately vertical longitudinal axis while maintaining said good ventilation and ensuring a safe return of the frame structure to its starting position, from which it may have been removed. At the same time, the frame structure is intended to provide a good load transfer of the backpack weight to the hip bone area.

The above object is attained by a backpack comprising a frame structure concavely stretching the backpack's back wall taut, said assembly holding a netting member in front of the backpack's back wall in bowstring fashion. The frame structure consists of a resilient frame member comprising two frame portions intersecting in front of the backpack back wall and a top frame portion extending transversely of the backpack, said top frame portion extending in the transverse direction of the backpack, interconnecting the top ends of frame portions (8, 9) and being held against backpack back wall (2), and of a frame member having two frame elements extending approximately in the longitudinal direction of the backpack and being spaced in the transverse direction thereof. The bottom ends of the frame portions are held to the backpack back wall in places spaced in the transverse direction of the backpack. The top ends of the frame elements and the bottom ends of the frame portions are held in place on the backpack back wall or on the netting, respectively.

The essential advantage of the inventive backpack, when carried, is that the particular two-part configuration of its frame structure operates to constantly hold the netting at a distance from the backpack back wall, resulting in an extremely good conformance of the frame structure to the body movements of the person carrying the backpack, and this especially in mountain climbing or during hikes across impassable terrain. Advantageously, the frame structure, when rotated from an initial position about the vertical backpack axis, will return to that initial position, ensuring enhanced carrying comfort in addition to good ventilation. Also advantageously, the special design of the frame structure results in the backpack weight being transferred to, and introduced in, the pelvic bone. Another advantage of the invention is the relatively low weight of the frame structure.

In a preferred further development of the invention, the top frame portion is inserted in a top pocket formed on the side of the backpack back wall facing away from the interior of the backpack. In another embodiment, featuring particular simplicity, the top frame portion is inserted in a downwardly open top pocket. The bottom ends of the frame portions are conveniently inserted in bottom pockets formed on the side of the backpack back wall facing away from the interior of the backpack, with the bottom insertion pockets holding the bottom ends of the frame portions being spaced in the transverse direction of the backpack. In an embodiment featuring particularly simplicity and practicality, the bottom ends of the frame portions are inserted in upwardly opening bottom pockets. The bottom ends of the frame portions may be angled to extend about transversely of backpack (1). This ensures a particularly effective engagement for the aforesaid bottom ends.

Particularly preferably, the frame portion is formed by a resilient wire member made of spring steel or of a plastics material. A resilient wire member of this type is inserted in the top and bottom insertion pockets in a most simple manner where these are downwardly or upwardly opening, respectively.

The netting member of the inventive backpack has its top edge portion secured to—and preferably sewn on—the top end of the backpack back wall. Accordingly, the netting member has its bottom corner portions, which are spaced in the transverse direction of the backpack, secured to—and preferably sewn on—the backpack back wall. Conveniently, the top and/or bottom edge portions of the netting may be reinforced or may be formed by reinforcing elements. The bottom corner portion or reinforcing elements may be hip or pelvis belts attached thereto so as to create a particularly good weight distribution.

The top end sections of the frame elements may be disposed on the side of the backpack back wall turned towards, or away from, the backpack's interior. The bottom end sections of the frame elements may be disposed on the side of the backpack back wall which is turned towards, or away from, the interior of backpack (1).

Regarding the weight distribution, there is particular advantage to an embodiment of the invention in which the top end sections of the frame elements are disposed each on the side of the backpack back wall turned towards the interior of the backpack and in which the frame elements each extend through an opening in the backpack back wall towards the side turned away from the interior of the backpack, with the bottom end sections of the frame elements inserted in pockets formed on the side of the corner portions turned towards the backpack back wall or of the reinforced portions of the netting. Conveniently, the frame elements extend through tunnel elements formed on the side of the backpack back wall turned towards the interior of the backpack between the top end sections of the frame elements and the openings on the side of the backpack back wall turned towards the interior of the backpack.

In a particularly simple manner, the tunnel members and/or the top insertion pockets for the top end sections of the frame elements and/or the bottom insertion pockets for the bottom end sections of the frame elements and/or the top insertion pocket of the top frame portion and/or the bottom insertion pockets for the bottom ends of the frame portions are formed by material elements fastened—and preferably sewn—on the back wall of the backwall.

In an advantageous further development of the invention, the frame elements are concavely accurate at least in parts. Conveniently, the frame elements are in the form of flat members. In particular, they are made of metal, preferably of aluminum.

An additional frame element may extend transversely below the points of intersection of the intersecting frame portions, said additional frame element concavely tensioning the backpack back wall even better. The additional frame element is disposed preferably on the side of the backpack back wall turned towards the interior of the backpack. To prevent said additional frame portion from shifting, it is disposed at least partly in an additional tunnel portion formed on the side of the backpack back wall turned towards the inside of the backpack. Conveniently, the additional frame element has the form of a flat member and consists particularly of metal, preferably of aluminum.

In order to keep the intersecting frame portions from shifting, they are held conveniently above the point of intersection by a holding member on the side of the backpack back wall turned away from the interior of the backpack. The holding member may be provided in a particularly simple and inexpensive manner by a material element covering the frame portions, said material element fastened—preferably sewn—to the backpack back wall.

The invention and its embodiments will not be explained in greater detail under reference to the Figures.

Figure 2:
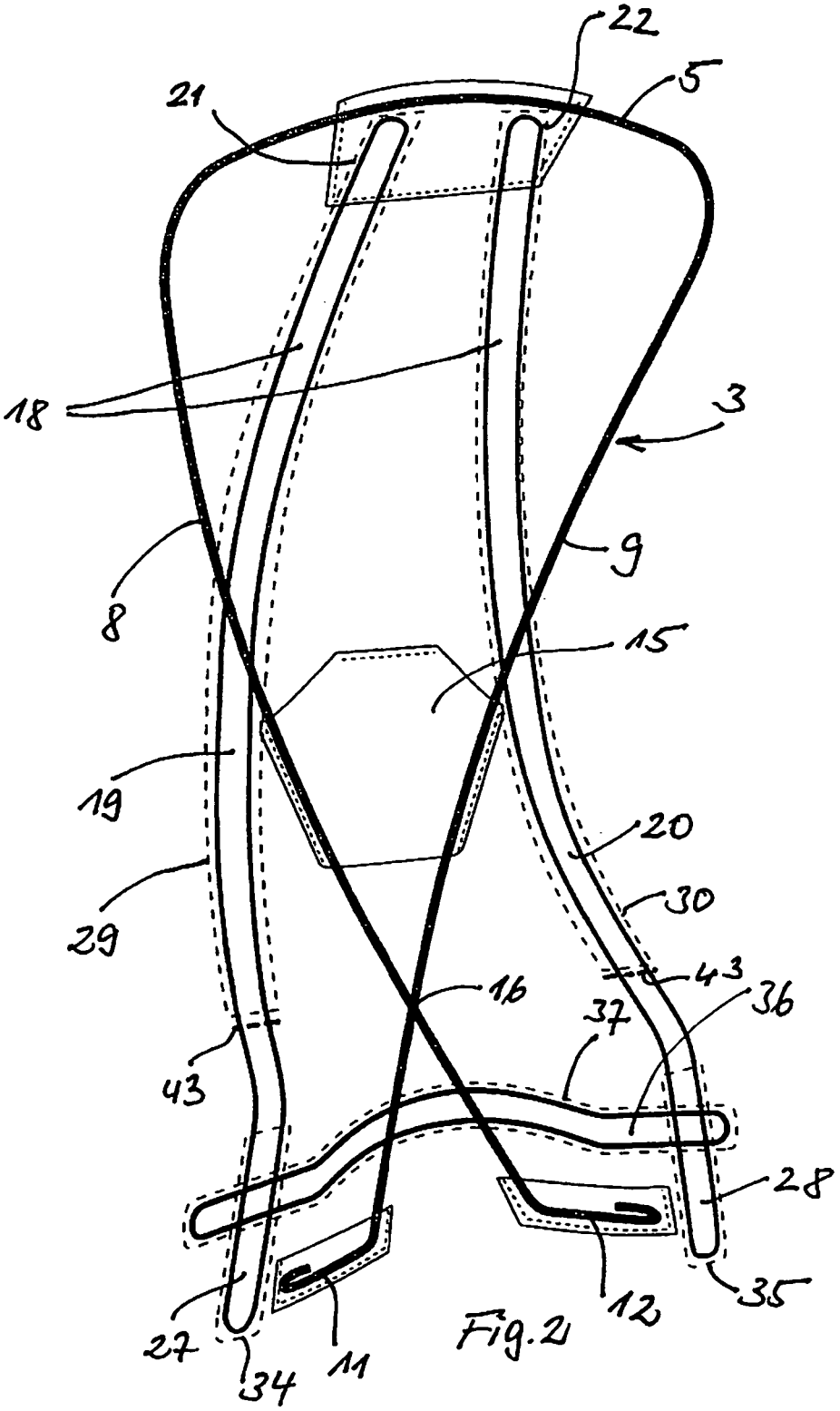
Figure 3:
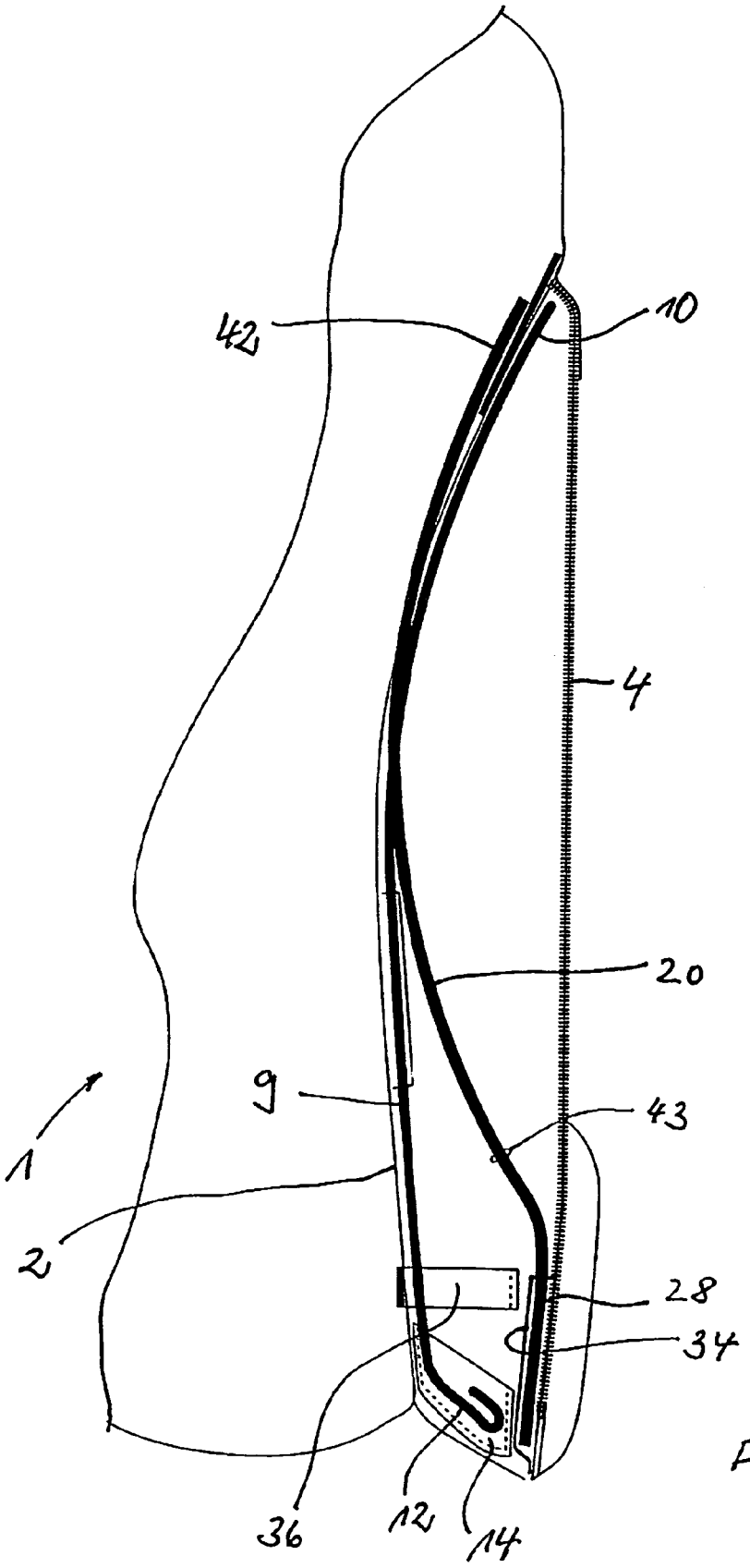

FIG. 1 schematically shows a view from the outside inwards of the back wall of the backpack and the netting;

FIG. 2 shows the frame structure of FIG. 1, omitting the netting concavely stretched taut by the frame structure; and FIG. 3 shows a sectional view of the assembly of FIG. 1 along line III-III.

The invention is based on the following considerations. In addition to a good ventilation of the space between the back wall of the backpack and the netting concavely stretched taut by the frame structure, a particularly good carrying comfort may be obtained by a division in two of the net-stretching frame structure. This division in two substantially de-couples the movements of the netting from those of the backpack. At the same time, the tension of the backpack back wall is maintained as is the tautness of the netting. Further, it is ensured that the force exerted by the load of the backpack is introduced on both sides of the longitudinal axis of the backpack and directly in the region of the person carrying the backpack. This again improves the carrying comfort.

As shown in FIG. 1, a netting member 4 is disposed in front of the back wall 2 of a backpack 1 and fastened—preferably sewn—by its top edge region 5 to the top portion of backpack back wall 2. Further, netting 4 is preferably fastened—preferably sewn—to backpack back wall 2 by its bottom corner portions 6, 7, which are spaced in the transverse direction of backpack 1. Upper edge area 5 and corner portions 6, 7 may be reinforced in the manner shown by reinforcing members 6', 7'. Also, it is contemplated for reinforcing members 6', 7' to be attached—preferably sewn—to netting 4 along lines 6", 7" from the outside and in a spaced relationship, with netting 4 not necessarily extending under reinforcing members 6', 7'.

In FIG. 1, a frame member stretching netting 4 concavely taut in front of the backpack back wall is referred to as 3. It consists substantially of a resilient rod member in wire-form which is disposed on the side of backpack back wall 2 turned towards the person carrying the backpack. Frame member 3 comprises two frame portions 8, 9 extending substantially parallel and intersecting in front of backpack back wall 2 on the side turned towards the person carrying the backpack, said frame portions interconnected at the top ends by a top frame portion 10 extending substantially in parallel. Preferably, bottom ends 11 and 12, respectively, of intersecting frame portions 8, 9 are outwardly angled—seen in the cross direction—and inserted in bottom pockets 13, 14 of backpack backwall 2. Conveniently, top frame portion 10 is inserted in a top pocket 17.

Preferably, bottom insertion pockets 13, 14 are formed conveniently —by textile material elements fastened—conveniently sewn—to the back pack back wall. Lower insertion pockets 13, 14 preferably are downwardly open, allowing the ready insertion of ends 11, 12 of flexible frame portion 3 after appropriate flexing thereof. Upper insertion pocket 17 is preferably formed by a textile material member fastened—conveniently sewn—to backpack back wall 2. The top insertion pocket preferably opens downwardly, allowing the ready insertion thereof of the top frame portion 10 of flexible frame member 3.

Resilient frame portion 3 is dimensioned to be concavely tensioned in the assembled condition. It preferably consists of spring steel or of a plastics material.

Seen in the longitudinal direction, the middle sections of frame portions 8, 9 are fastened to backpack back wall 2 by a holding member 15 covering them preferably above the point 16 of intersection 16. Holding member 15 is preferably formed by a textile material member fastened—preferably sewn—to backpack back wall 2.

In accordance with the invention, there is provided a further frame member 18 comprising at least two frame elements 19, 20 extending approximately in the direction of the longitudinal axis of backpack 1. These frame elements 19, 20 preferably are not interconnected. They have form of a flat frame element each which consists preferably of a resilient steel material. The top ends of frame elements 19, 20 are inserted in a downwardly open top pocket 21, 22, respectively. Insertion pockets 21, 22 are located preferably on the side of backpack back wall 2 turned away from netting 4. They are preferably formed in a common textile material member fastened—preferably sewn—to backpack back wall 2.

Starting from top insertion pockets 21, 22, the flat frame elements 19, 20 preferably extend downwards approximately in the direction of longitudinal axis 23 of backpack 1 on the inside of backpack back wall 2 turned away from the person carrying the backpack. Backpack back wall 2 has there through openings 43 through which frame elements 19, 20 extend towards the side of backpack back wall 2 turned towards netting 4, with the end sections of frame elements 19, 20 inserted in pockets 34, 35 preferably provided on the side turned towards backpack back wall 2 of corner portions 6, 7 of netting 4 or reinforcing members 6', 7'. As the hip straps or hip fins shown in phantom lines 39, 40 in FIG. 1 are attached to these corner portions 6, 7 or reinforcing members 6', 7', respectively, The force exerted by the load of the back pack is introduced in, and transferred to, the hip belts or fins and in the area of the pelvic bones in a most advantageous manner.

On the side turned towards the interior of the backpack, frame elements 19, 20 preferably extend through tunnel portions preferably formed by textile material members fastened—preferably sewn—to backpack back wall 2. Between the top and bottom end sections 27, 28, frame elements 19, 20 preferably are formed to be permanently accurate so as to concavely tension backpack back wall 2 in a direction towards the interior of the backpack. Lower end sections 27, 28 of frame elements 19, 20 are bent preferably in a manner to extend approximately in the plane of corner portions 6, 7 or reinforcing members 6', 7' for good introduction of the aforesaid force.

It is contemplated to alternatively attach insertion pockets 34, 35 for the bottom end section 27, 28 of frame elements 19, 20 to the side of backpack back wall 2 turned towards the interior of backpack 1. It is contemplated also to provide frame elements 19, 20 in their entirety on the side of the backpack back wall turned towards netting 4, with the top and bottom insertion pockets 21, 22 and 34, 35, respectively, then disposed on that side also.

In the manner shown in FIG. 1, netting member 4 covers first frame member 3 and frame elements 19, 20 and is fixed in place on backpack back wall 2 by the end of its top end region by a seam 31. At the edges of its bottom corner portions 6, 7, netting member 4 is fixed to backpack back wall 2 preferably by seams 32, 33. Insertion pocket 17 for transverse member 5 is preferably formed between backpack back wall 2 and the top end section of netting member 4, which may be reinforced.

Insertion pockets 34, 35 are upwardly open, preferably. They are formed preferably by textile material elements fastened—preferably sewn—to corner portions 6, 7 or the aforesaid regions of the backpack back wall.

By the construction described above of the assembly comprising frame elements 19, 20 and frame element 3, backpack back wall 2 is concavely tensioned towards the interior of backpack 1, on the one hand; on the other hand, netting member 4 is stretched taut in bowstring fashion in front of the backpack back wall 2, which is tensioned to be concave towards the interior, creating a ventilation space between backpack back wall 2 and netting member 4.

To make possible an improved stretching of backpack back wall 2 in the bottom end area thereof, there is provided a frame element 36, preferably consisting also of a flat member such as steel and extending in the transverse direction through a tunnel 37 on the side of backpack back wall 2 turned away from netting 4. Tunnel 37 is preferably formed by a textile material member fastened—preferably sewn—to backpack back wall 2. Frame element 36 is formed to be accurate between its end sections so as to create—seen in a transverse direction—between backpack backwall 2 and netting 4 and midways between corner portions 27, 28 of the latter a particularly deep space for enhanced ventilation.

The bottom end sections of frame elements 19, 20 being disposed in a particularly advantageous manner behind the corner portions 6, 7 of netting 4, which are connected with backpack back wall 2, it becomes possible for the force exerted by the load of backpack 1 to be directly introduced into the hip belts or hip fins—shown by phantom lines 40—preferably connected to end sections 6, 7.

The particular construction of the multi-part frame structure and the resultant concave tautness of backpack back wall 2, as well as the bowstring-like tensioning of netting 4 in front of the frame structure, make possible a free rotation of the latter from an initial position about the longitudinal axis of backpack 1, with the flexible configuration of the frame structure in its entirety causing it to return to that initial position after having been removed from it. This results a particularly high carrying comfort even on impassable terrain, where a person carrying the backpack may perform vigorous movements.

REFERENCE CHARACTERS

1 backpack
2 back wall of the backpack
3 frame member
4 netting member
5 edge portion
6 corner portion
6' reinforcing element
6" line
7 corner portion
7' reinforcing element
7" line
8 frame section or portion
9 frame section or portion
10 frame section or portion
11 end
12 end
13 insertion pocket
14 insertion pocket
15 holding member
16 point of intersection
17 insertion pocket
18 frame element
19 frame element
20 frame element
21 insertion pocket
22 insertion pocket
23 longitudinal axis
27 end section
28 end section
29 tunnel area
30 tunnel area
31 seam
32 seam
33 seam
34 insertion pocket
35 insertion pocket
36 frame element
37 tunnel
38 longitudinal axis
39 line
40 line
41 end section
42 end section
43 opening

The invention claimed is:

1. Backpack (1) comprising:

a frame structure stretching a back wall (2) of the backpack (1) to be concavely taut and holding a netting member (4) in front of the backpack back wall (2) in bowstring fashion, said frame structure comprising:

a resilient first frame member (3) having a pair of frame portions (8, 9) intersecting in front of the backpack back wall (2) and an interconnected top frame portion (10) which extends in a transverse direction of the backpack (1), has opposite end portions fixed to and interconnecting with top ends of said frame portions (8, 9) and is held to the backpack back wall (2); and a second frame member (18) comprising a pair of frame elements (19, 20) extending vertically approximately in a longitudinal direction of the backpack (1) and mutually spaced in the transverse direction thereof, said transverse direction oriented transverse to said longitudinal direction wherein said second frame member concavely tensions said backpack back wall, said frame elements of said second frame member being decoupled from and movable separate from said interconnected frame portions and top frame portion of said first frame member;

with bottom ends of said frame portions (8, 9) being held to the backpack back wall (2) in places mutually spaced in the transverse direction of the backpack (1) on opposite sides of a vertical longitudinal axis of the backpack (1) so that said first frame member is concavely tensioned with said backpack back wall wherein said netting member is stretched taut in a bowstring fashion; and with top ends of said frame elements (19, 20) being held to the backpack back wall (2) and bottom end sections (27, 28) of said frame elements (19, 20) being held to the backpack back wall (2) or to the netting member (4), wherein the frame portions (8, 9) of said first frame member (3) are decoupled from said second frame member to allow movements of said netting member (4) which said movements of said netting member are decoupled from the movements of the backpack (1) which has said back wall (2) supported by said frame elements (19, 20), so that the netting member (4) has free rotation relative to the back wall (2) about said vertical longitudinal axis.

2. Backpack as in claim 1, characterized by said top frame portion (10) being disposed in a top insertion pocket formed on a side of backpack back wall (2) turned away from an interior of the backpack (1).

3. Backpack as in claim 2, characterized by said top frame portion (10) being inserted in the top insertion pocket (17) which opens downwardly.

4. Backpack as in claim 1, characterized by the bottom ends of said frame portions (8, 9) being disposed in bottom insertion pockets (13, 14) formed on a side of the backpack back wall (2) turned away of an interior of the backpack (1), with the bottom insertion pockets (13, 14) holding the bottom ends of said frame portions (8, 9) which are mutually spaced in the transverse direction of the backpack (1).

5. Backpack as in claim 4, characterized by the bottom ends of said frame portions (8, 9) being inserted in said bottom insertion pockets (13, 14) which open upwardly.

6. Backpack as in claim 4, characterized by said bottom ends of said frame portions (8, 9) being angled to extend approximately in the transverse direction of the backpack (1).

7. Backpack as in claim 1, characterized by said first frame member (3) comprising a resilient supporting member.

8. Backpack as in claim 7, characterized by said supporting member comprising spring steel or being a plastics member.

9. Backpack as in claim 1, characterized by said netting member (4) being fastened by a top edge area (5) to a top portion of said backpack back wall (2).

10. Backpack as in claim 9, characterized by said netting member (4) being fastened to said backpack back wall (2) by bottom corner portions (6, 7) thereof mutually spaced in the transverse direction of the backpack (1), at least one of said top edge portion (5) and said bottom corner portions (6, 7) of said netting member (4) being reinforced.

11. Backpack as in claim 10, characterized by said bottom corner portions (6, 7) of said netting member (4) being reinforced by reinforcing members (6', 7').

12. Backpack as in claim 11, characterized by said bottom end sections (27, 28) of said frame elements (19, 20) extending approximately in the plane of said corner portions (6, 7) or said reinforcing members (6', 7').

13. Backpack as in claim 10, characterized by the bottom corner portions (6, 7) of said netting member (4) being reinforced by reinforcing members (6', 7') connected with said netting member (4) along a line (6", 7").

14. Backpack as in claim 1, characterized by said netting member (4) being fastened to said backpack back wall (2) by bottom corner portions (6, 7) thereof mutually spaced in the transverse direction of the backpack (1).

15. Backpack as in claim 14, characterized by hip belts or hip fins attached to said bottom corner portions (6, 7) or to reinforcing members (6', 7') which reinforce said bottom corner portions.

16. Backpack as in claim 1, characterized by top end sections (41, 42) of said frame elements (19, 20) each being disposed on a side of the backpack back wall (2) turned towards an interior of the backpack (1).

17. Backpack as in claim 16, characterized by the bottom end sections (27, 28) of said frame elements (19, 20) each being disposed on a side of the backpack back wall (2) turned towards an interior of the backpack (1).

18. Backpack as in claim 1, characterized by top end sections (41, 42) of said frame elements (19, 20) each being disposed on a side of the backpack back wall (2) turned away from an interior of the backpack (1).

19. Backpack as in claim 18, characterized by the bottom end sections (27, 28) of said frame elements (19, 20) each being disposed on a side of the backpack back wall (2) turned away from an interior of backpack (1).

20. Backpack as in claim 1, characterized by top end sections (41, 42) of said frame elements (19, 20) each being disposed on an inner side of the backpack back wall (2) turned towards an interior of the backpack (1) and the bottom end sections (27, 28) of said frame elements (19, 20) each being disposed on an outer side of the backpack back wall (2) turned away from the interior of the backpack (1).

21. Backpack as in claim 1, characterized by said frame elements (19, 20) extending at least partly through tunnel areas (29, 30) on a side of the backpack back wall (2) turned towards an interior of the backpack (1).

22. Backpack as in claim 21, characterized by said frame elements (19, 20) extending through said tunnel areas (29, 30) which are formed on the side of the backpack back wall (2) turned towards the interior of the backpack (1) between top end sections (41, 42) of said frame elements (19, 20) and openings (43) formed through the backpack back wall.

23. Backpack as in claim 1, characterized by at least one of tunnel areas (29, 30) and top insertion pockets (21, 22) for top end sections (41, 42) of said frame elements (19, 20), bottom insertion pockets (34, 35) for said bottom end sections (27, 28) of said frame elements (19, 20), a top insertion pocket (17) for said top frame portion (10) of said first frame member (3), and bottom insertion pockets (13, 14) for the bottom ends of said frame portions (8, 9) being formed by material members fastened to the backpack back wall (2) or to the netting member (4).

24. Backpack as in claim 1, characterized by said frame elements (19, 20) being bent to be concave at least in parts.

25. Backpack as in claim 1, characterized by said frame elements (19, 20) having the form of flat members.

26. Backpack as in claim 1, characterized by said frame elements (19, 20) comprising a metal.

27. Backpack as in claim 1, characterized by an additional frame element (36) extending in a transverse direction below a point of intersection (16) between said frame portions (8, 9), said additional frame element stretching said backpack back wall (2) to be concavely taut.

28. Backpack as in claim 27, characterized by at least a portion of said additional frame element (36) being bent to be concave.

29. Backpack as in claim 27, characterized by said additional frame element (36) being disposed on a side of backpack back wall (2) turned towards an interior of the backpack (1).

30. Backpack as in claim 27, characterized by said frame elements (19, 20) extending at least partly through tunnel areas (29, 30) on a side of the backpack back wall (2) turned towards an interior of the backpack (1), and said additional frame element (36) being disposed in another tunnel area (37) formed on the side of the backpack back wall (2) turned towards the interior of the backpack (1).

31. Backpack as in claim 27, characterized by said additional frame element (36) having the form of a flat member.

32. Backpack as in claim 27, characterized by said additional frame element (36) comprised of metal.

33. Backpack as in claim 1, characterized by the frame portions (8, 9) of said first frame member being held to a side of the backpack back wall (2) turned away from an interior of the backpack (1) by a holding member (15) located above a point of intersection (16) between said frame portions.

34. Backpack as in claim 33, characterized by the holding member (15) being formed by a material member covering said frame portions and fastened to the backpack back wall (2).

* * * * *